US005329241A

United States Patent [19]

Reusch

[11] Patent Number: 5,329,241

[45] Date of Patent: Jul. 12, 1994

[54] PULSED SYNCHROTRON SOURCE

[76] Inventor: Michael F. Reusch, 7 Windsor Dr., Princeton Junction, N.J. 08550

[21] Appl. No.: 866,981

[22] Filed: Apr. 10, 1992

[51] Int. Cl.[5] ..... H05H 7/04

[52] U.S. Cl. ..... 328/235; 328/233; 328/256; 328/260; 328/228; 328/230

[58] Field of Search ..... 328/233, 235, 256, 260, 328/228, 234, 237, 230; 315/256, 260; 335/213; 313/156

[56] References Cited

U.S. PATENT DOCUMENTS 4,812,774 3/1989 Tsumaki et al. ..... 328/235 X

FOREIGN PATENT DOCUMENTS 2223350 4/1990 United Kingdom ..... 328/235

OTHER PUBLICATIONS

R. T. Elliott, "A Pulsed Dipole Magnet Providing 100 kG Across 40 cm for Hyperon Experiments," Rutherford High Energy Lab. Chilton Didcot, Berkshire, England, pp. 1594–1611 from Proceedings of The Third International Conference on Magnet Technology, Hamburg, 1970.

*Primary Examiner*—Donald J. Yusko
*Assistant Examiner*—Ashok Patel
*Attorney, Agent, or Firm*—Pollock, Vande Sande & Priddy

[57] ABSTRACT

A racetrack synchrotron employs semi-circular 180 degree dipole magnets having coils which are pulsed by capacitor banks for quickly raising the energy of electrons flowing within the synchrotron. The inclusion of an RF cavity or cavities ensures that the energy of electrons follows the synchronous energy as the synchronous energy increases with the magnetic field. Pulsed quadrupole magnets, along the straight sections of the racetrack, ensure transverse confinement of the electrons. An ejection kicker magnetically diverts electrons from the synchrotron for use by an external device.

8 Claims, 2 Drawing Sheets

PULSED SYNCHROTRON SOURCE

FIELD OF THE INVENTION

The present invention relates to apparatus for increasing the kinetic energy of charged particles, i.e., accelerators, and more particularly to devices known as synchrotron accelerators, of which the present invention is a novel variant.

BACKGROUND OF THE INVENTION

Electron storage rings operating at an energy near 1 GeV (one billion electron volts) are typically used as light sources producing X-rays or UV light. The electron storage rings are oblong, re-entrant, loop structures in which bunches of electrons circulate, emitting synchrotron radiation whenever they are bent into a curved path. The energy lost by the electrons through radiation is replaced by passing them through radio frequency (RF) accelerating cavities which restore the lost electron energy.

Such electron storage rings are typically injected with electrons of energies considerably lower than the operating energy of the ring because of the cost and size of a full-energy injector of electrons. For example, a known prior art device operates at 700 MeV (million electron volts) and is injected at 200 MeV by an electron linac. This linac, essentially a series of RF cavities, is 36 meters long and costs about four million dollars to build. Roughly, cost and length scale linearly with energy. A 1 GeV electron linac would cost twenty million dollars and be 180 meters long.

Reduced energy injection of an electron storage ring produces several problems. First, the beam lifetime at reduced energies is only a few minutes. As a result, the beam must be injected quickly and a reduced-energy injector must supply a lot of electrons (100 milliamps at 10 Hertz). Second, the storage ring must be ramped to full energy within these few minutes to minimize loss of electrons. This restricts the design of the storage ring's bending magnets. These are subject to both eddy currents, hysteresis, and time-changing loads. Third, the storage ring is unusable while it is being injected and ramped to full energy.

A great advance would occur if a constant-energy, full-energy storage ring could be made practical through a cheap method of full-energy injection. This would allow full-energy storage rings to be simpler in construction and cheaper to build and permit the use of permanent magnets in place of the conventional electromagnets used in these prior art machines. Further, this would eliminate the need for the huge power supplies and cooling systems necessary to operate prior art storage ring devices.

BRIEF DESCRIPTION OF THE PRESENT INVENTION

The present invention proposes to accomplish an inexpensive form of full-energy injection of a storage ring through the use of a specialized type of pulsed synchrotron which brings a small amount of current (10 milliamperes) through a large energy difference, of from several MeV to 1 GeV, in a short time of several milliseconds.

This pulsed synchrotron incorporates two, 180 degree, pulsed, high-field, bending magnets at opposite ends of a racetrack-shaped ring which bend the particles into a closed racetrack-shaped orbit. One or several radio-frequency (RF) cavities are placed in the straight sections of the device for accelerating the particles and to replace the energy lost through collisions, bunch-wall interactions and radiation as in conventional synchrotrons. Also placed in the straight sections of the racetrack are pulsed focusing magnets, such as transverse quadrupole magnets, and a pulsed ejection or kicker magnet for the removal of the accelerated particles for injection into the storage ring.

Although synchrotrons have been employed in the prior art using electromagnets, and so-called "fast-cycling" accelerators exist which accomplish their energy ramp as often as sixty times per second, the present invention is centered upon the unique utilization of a special type of high-field pulsed electromagnet to 1) accelerate particles through a larger energy difference (1 MeV to 1 GeV) than has been heretofore considered, implying larger ultimate magnetic field values, i.e., on the order of 10 Tesla;
2) accomplish this energy ramp at a faster rate than has usually been considered in the prior art (1 to 5 milliseconds) in order to reduce the capacity of the power supply to a reasonable and practical value; and
3) take advantage of the possibility of the low duty-factor operation of a full energy injector of a 1 GeV storage ring to allow the pulsed magnets and their power supply (a capacitor bank) to be simpler and cheaper than is found in the prior art.

Ramping of the energy in a synchrotron is achieved by increasing the field of the bending magnets, not by increasing the RF power. Electrons in the machine are held in the so-called RF bucket in a stable manner. This bucket, which is the region of stable longitudinal confinement, is centered around a synchronous energy which is determined by the field strength of the bending magnets.

At energies above 1 MeV, all the electrons in the synchrotron move at essentially the speed of light. Electrons with too little energy are bent more in the bending magnets, move through a shorter path length in going around the machine, and arrive back at the RF cavity a little too soon. When the RF field is properly phased, these energy-deficient electrons see a stronger electric field and get more of a kick in traversing the cavity. Electrons with too great an energy arrive a little too late and receive a smaller kick. The result is stable oscillation of the particles around the synchronous energy. If the magnetic field in the bending magnets is increased, electrons are bent more, and arrive at the cavity sooner, receive a larger impulse, and, on average, increase in energy. Thus, the synchronous energy is increased by ramping up the magnetic field in the bending magnets. The average energy of the electron bunch also increases.

Often, it is mistakenly thought that the rate of energy increase must be adiabatic (slow) for this synchronization to occur and a region of stable confinement to exist. However, it is possible, as computer simulations of this process by the inventor have demonstrated, for the rate of energy increase to be quite large and non-adiabatic, on the order of 1 GeV per millisecond, while still achieving energy synchronization and significant capture of particles into an RF bucket and, further, while not exceeding the voltage and power limitations of conventional RF cavities.

The present invention achieves the desired pulsed synchrotron operation by initially introducing low energy electrons into the racetrack circuit of the synchrotron in which the bending and focusing magnets have been excited to produce the low values of constant magnetic field required at this energy. The coils of these magnets are then connected to capacitor banks, which discharge through them creating a rapidly increasing magnetic field in the bending magnets and focusing magnets. The combination of rising field together with the RF cavity or cavities provides stable oscillation of the particles around the synchronous energy. This synchronous energy increases in concert with the magnetic field.

Although the prior art includes straight pulsed electromagnets for use as injection kickers and alternating current bending electromagnets in the fast-cycling accelerators, the present invention is the first known attempt to combine pulsed high-field bending and focusing magnets powered by capacitor banks together with an RF cavity in a synchrotron accelerator configuration. In fact, this scheme would be impractical except for its intended low duty-factor operation. Otherwise, the power dissipated in the pulsed magnets under frequent repetitive operation would exceed reasonable limits.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
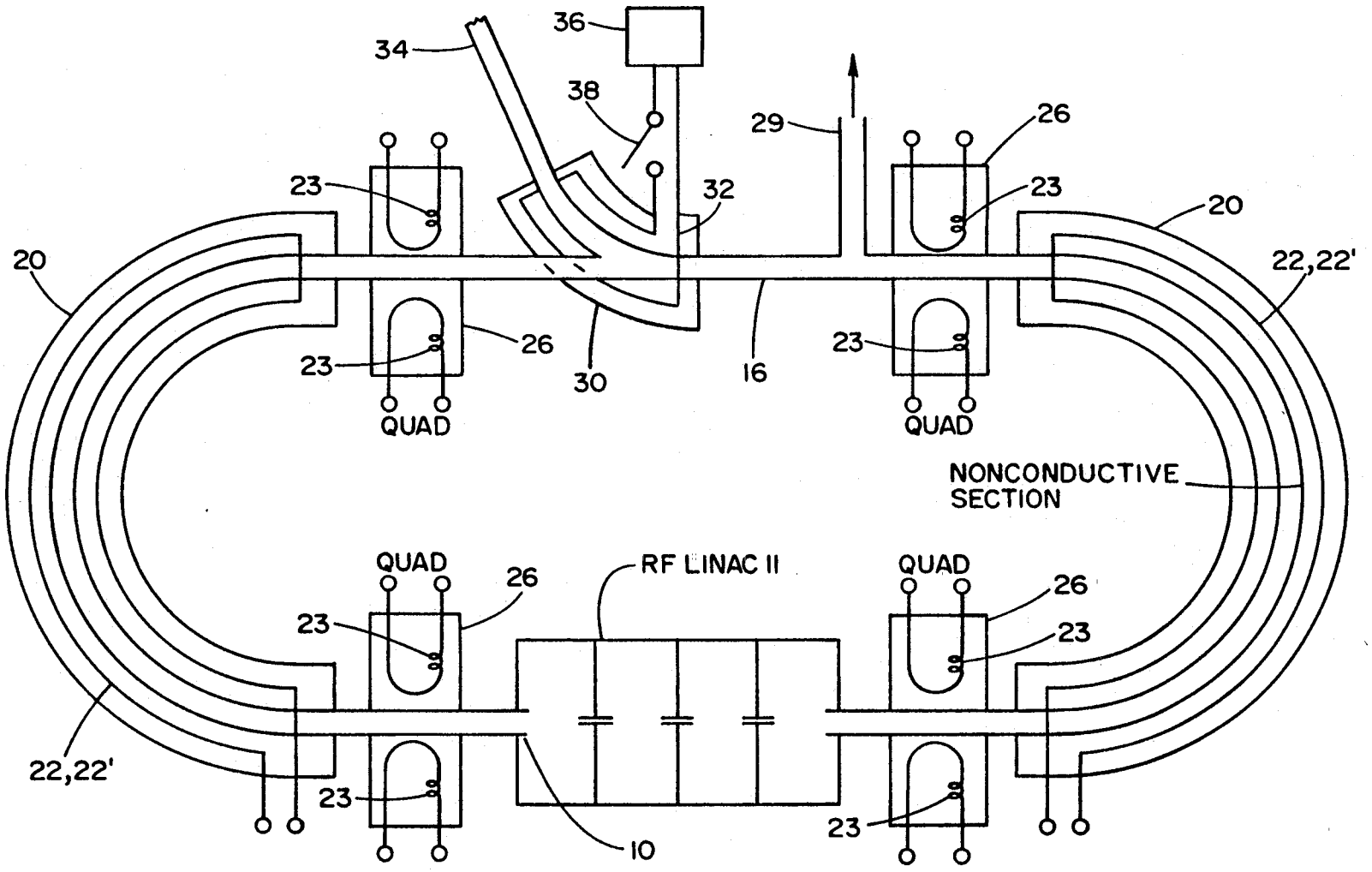
FIG. 1 is a block diagram of the present pulsed synchrotron.

The figure illustrates a pulsed synchrotron in accordance with the present invention. Reference numeral 10 indicates a source of low energy electrons, such as a hot wire cathode or photo-cathode and possibly an associated electrostatic acceleration mechanism such that these electrons are introduced into the device at energies less than or on the order of 100 keV.

This electron source is placed inside of and at the beginning of an RF cavity or RF linac 11 in such a manner as not to interfere with the path of the beam. For example, the electron source might be conveniently constructed in the form of an annular ring around the beam path.

The purpose of this RF cavity or RF linac, which is essentially a sequence of RF cavities, is to synchronously accelerate the electrons passing therethrough.

Figure 2:
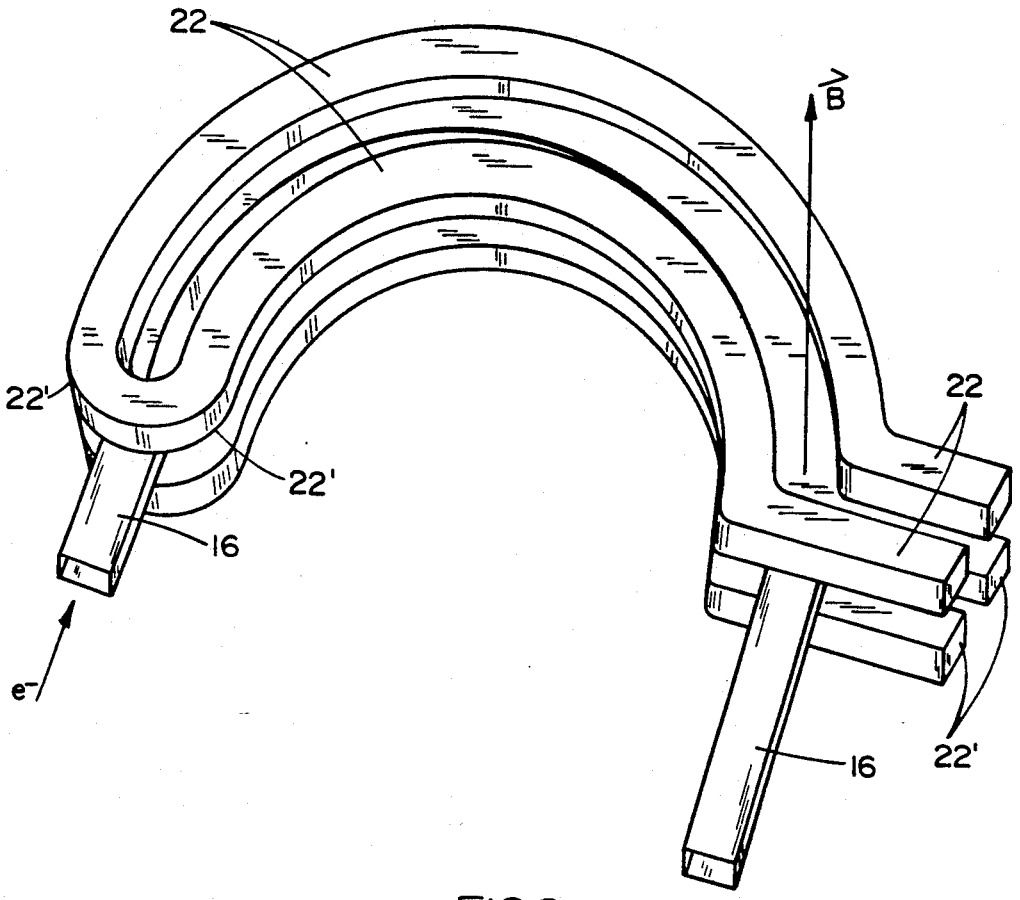
FIG. 2 is a perspective view of a bending magnet section of the invention.

The RF cavity communicates with a hollow tube 16 which defines the parallel linear sections of the racetrack. As shown in FIG. 2, this tube extends through the center of the bending magnets 20 which are semicircular electromagnets which produce vertically oriented (out of the figure) uniform magnetic fields within the tube at opposite ends of the racetrack. This tube also extends through the transversely located focusing magnets (QUADS) 26. These focusing magnets 26, along with the bending magnets, serve to confine the electrons within the tube. Tube 16 and the interior of the RF cavities are evacuated via vacuum line 29 and constitute a racetrack-shaped vacuum pipe.

An important design criterion is that the portion of this vacuum pipe which passes through the bending and focusing magnets be made of some nonconductive material so that the pulsed, time-changing magnetic field can penetrate the tube quickly in these regions. Typical materials which might be employed in these regions may be alumina or a ceramic material. The remaining portions of the vacuum pipe may be fabricated from a suitable metallic material.

In addition, the interior surface of these non-conductive portions of the vacuum pipe may have a thin, segmented coating of highly conductive material, such as gold, which is divided by non-conducting regions in a standard manner so as to allow this magnetic field penetration. This coating serves to suppress certain well-known beam instabilities by reducing the impedance of the pipe in its electromagnetic interaction with the electrons passing within it.

Figure 3:
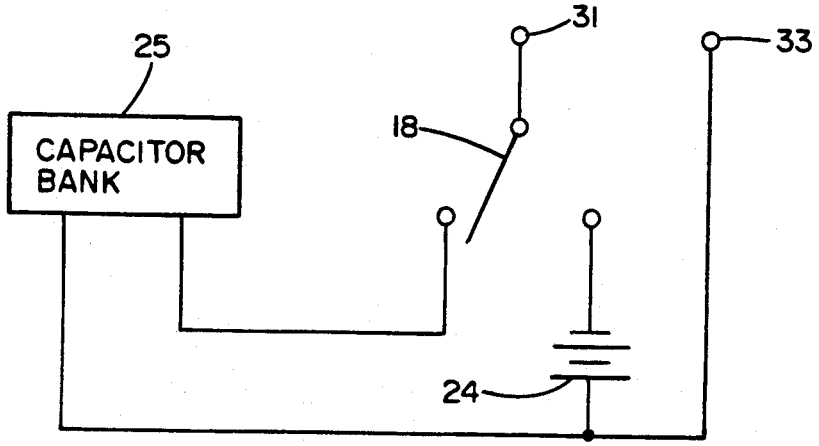
FIG. 3 is a simplified circuit diagram of switching means for a capacitor bank.

The coils (22, 22') and 23 of each bending magnet and focusing magnet, respectively are first connected in series to terminals 31 and 33 of a DC current source 24 via switch 18, shown in FIG. 3. Thus far described, the magnets will develop a DC magnetic field of a low, appropriate magnitude so as to cause the electrons to circulate within the ring. By operating in this DC mode for a period, the racetrack ring may be filled with low-energy electrons.

When the maximum number of electrons has been reached, switch 18 is switched to a conventional capacitor bank 25 (FIG. 3) connected in series across the bending magnets 20 and focusing magnets 26. The result will be a half sinusoidal wave-shaped, pulsed energization of these magnets, which quickly increases the magnetic fields within the bending and focusing elements, and consequent elevation of the energy of electrons flowing within the ring. The conventional capacitor bank 25 actually comprises inductive and capacitive components which clip the half sinusoidal wave-shaped pulse to create a single half-wave pulse. By allowing this pulse to swing through one half wave and then opening switch 18, much of the initial energy in capacitor bank 25 may be recovered.

When the peak of this half-wave is reached, or when the energy of the electrons has reached a sufficiently high level, an ejection kicker 30 is energized so as to divert these electrons to an outlet path along tube 34. From there, the energy elevated electrons may be employed for a number of purposes well known to those in the art. In particular, they may be injected into a constant, full-energy storage ring.

The ejection kicker is basically a fast arcuate electromagnet producing a uniform vertical magnetic field in tube 16. As shown in FIG. 1, it incorporates coil 32, which is connected across a separate capacitor bank 36, smaller than capacitor bank 25. Capacitor bank 36 becomes operational when switch 38 is closed. Energization of the coil 32 bends the path of the electrons flowing through the section of tube 16, communicating with the ejection kicker 30. This bending diverts the elevated energy electron flow to the ejection tube 34.

It should be understood that the invention is not limited to the exact details of construction shown and described herein for obvious modifications will occur to persons skilled in the art.

I claim:

1. A pulsed synchrotron configured as a closed ring and comprising:

parallel spaced straight conduits for containing electron flow therein;

a plurality of arcuate pulsed bending electromagnets positioned between the straight conduits such that the total bending angle of the bending electromagnets is 360 degrees, and containing therein passages communicating with the straight conduits to guide arcuate electron flow through the bending magnets;

at least one RF cavity interposed along the ring for synchronous acceleration of the electrons flowing within the ring;

means for introducing low-energy electrons into the ring;

means for providing DC power across coils of the electromagnets;

means of subsequently applying a power pulse across the coils of the electromagnets for contributing in quickly raising energy of the electrons as the RF cavity continues to accelerate the electrons to a vicinity of synchronous energy.

2. The synchrotron set forth in claim 1 wherein the arcuate bending electromagnets are configured as semicircular shapes.

3. The synchrotron set forth in claim 1 wherein the means for applying the power pulse across the coils of the electromagnets includes a capacitor bank.

4. The synchrotron set forth in claim 1 further comprising electromagnetic means located along the conduit and selectively switched on after application of the power pulse for diverting the electron flow at an elevated energy level from the ring to a separate path.

5. The synchrotron set forth in claim 3 further comprising a series of transverse focusing quadrupole field electromagnets placed along the straight conduits and similarly powered simultaneous with the application of power across the bending magnet coils, these quadrupole field electromagnets serving to transversely focus electrons flowing within the ring.

6. A method for increasing energy of electrons comprising the steps of:

introducing low energy electrons into a closed ring;

applying radio frequency excitation to the electrons flowing in the ring thereby causing them to exhibit stable oscillations about a synchronous energy;

applying DC vertical magnetic fields at curved portions of the ring for a first time interval; and subsequently applying pulsed vertical magnetic fields at the curved portions of the ring for contributing to increasing the synchronous energy of the electrons.

7. The method set forth in claim 6 further comprising with a magnetic diversion of the high energy electrons resulting from the energy impulse into a path external to the ring.

8. The method set forth in claim 7 further comprising the steps of subjecting the particles in the ring to DC and pulsed magnetic fields along straight sections of the ring to transversely focus electrons flowing within the ring, the fields being respectively applied simultaneously with the fields applied at the curved portions of ring.

* * * * *